US009090983B2

(12) United States Patent
Brichese et al.

(10) Patent No.: US 9,090,983 B2
(45) Date of Patent: Jul. 28, 2015

(54) ELECTRODE FOR ELECTROCHEMICAL PROCESSES AND METHOD FOR OBTAINING THE SAME

(75) Inventors: Marianna Brichese, Caorle (IT); Antonio Lorenzo Antozzi, Merate (IT); Alice Calderara, Milan (IT)

(73) Assignee: INDUSTRIE DE NORA S.P.A., Milan (IT)

( * ) Notice: Subject to any disclaimer, the term of this patent is extended or adjusted under 35 U.S.C. 154(b) by 331 days.

(21) Appl. No.: 13/590,649

(22) Filed: Aug. 21, 2012

(65) Prior Publication Data

US 2012/0312683 A1 Dec. 13, 2012

Related U.S. Application Data

(63) Continuation of application No. PCT/EP2011/052542, filed on Feb. 21, 2011.

(30) Foreign Application Priority Data

Feb. 22, 2010 (IT) ..... MI2010A0268

(51) Int. Cl.

| | |
|---|---|
| ***H01M 4/88*** | (2006.01) |
| ***B01J 23/46*** | (2006.01) |
| ***B01J 23/63*** | (2006.01) |
| ***B01J 37/04*** | (2006.01) |
| ***B23H 3/04*** | (2006.01) |
| ***B23H 5/10*** | (2006.01) |
| ***B23H 7/22*** | (2006.01) |
| ***C25B 11/00*** | (2006.01) |
| ***C25C 7/02*** | (2006.01) |
| ***C25D 17/10*** | (2006.01) |
| ***C25F 7/00*** | (2006.01) |
| ***C25B 11/04*** | (2006.01) |

(52) U.S. Cl.
CPC ..... *C25B 11/0484* (2013.01)

(58) Field of Classification Search
USPC ..... 502/101; 204/290.06, 290.04, 290.1, 204/290.14
See application file for complete search history.

(56) References Cited

U.S. PATENT DOCUMENTS

| | | | | |
|---|---|---|---|---|
| 4,157,943 | A * | 6/1979 | Scarpellino et al. | 205/176 |
| 4,871,703 | A * | 10/1989 | Beaver et al. | 502/101 |
| 5,358,889 | A | 10/1994 | Emesh | |
| 2006/0231387 | A1 | 10/2006 | Houda | |
| 2012/0199473 | A1 * | 8/2012 | Antozzi et al. | 204/242 |
| 2014/0008215 | A1 * | 1/2014 | Brichese et al. | 204/290.14 |

FOREIGN PATENT DOCUMENTS

| | | | |
|---|---|---|---|
| EP | 1916320 | A2 | 4/2008 |
| WO | 2008043766 | A2 | 4/2008 |

OTHER PUBLICATIONS

Search Report dated May 26, 2011 in connection with patent application PCT/EP2011/052542.

* cited by examiner

*Primary Examiner* — Patricia L Hailey
(74) *Attorney, Agent, or Firm* — Lucas & Mercanti, LLP

(57) ABSTRACT

An electrode suitable for use as hydrogen-evolving cathode in electrolytic processes is obtained by thermal decomposition of a precursor consisting of an acetic solution of nitrates of ruthenium, and optionally of rare earths. The electrode displays a low cathodic hydrogen evolution overpotential, an improved tolerance to current reversal phenomena and a high duration in industrial operating conditions.

15 Claims, No Drawings

ELECTRODE FOR ELECTROCHEMICAL PROCESSES AND METHOD FOR OBTAINING THE SAME

CROSS-REFERENCE TO RELATED APPLICATION

This application is a continuation of PCT/EP2011/052542 filed Feb. 21, 2011, that claims the benefit of the priority date of Italian Patent Application No. MI2010A000268 filed Feb. 22, 2010, the contents of which are herein incorporated by reference in their entirety.

FIELD OF THE INVENTION

The invention relates to an electrode for electrolytic processes, in particular to a cathode suitable for hydrogen evolution in an industrial electrolytic process and to a method for obtaining the same.

BACKGROUND OF THE INVENTION

The invention relates to an electrode for electrolytic processes, in particular to a cathode suitable for hydrogen evolution in an industrial electrolytic process. The electrolysis of alkali brines for the simultaneous production of chlorine and alkali and the electrochemical processes of hypochlorite and chlorate manufacturing are the most typical examples of industrial electrolytic applications where hydrogen is cathodically evolved, but the electrode is not limited to any particular application. In the industry of electrolytic processes, competitiveness depends on several factors, and primarily on the reduction of energy consumption, which is directly associated with the operating voltage. This is the main reason behind the efforts directed to reduce the various components making up the cell voltage, cathodic overvoltage being one of those. Cathodic overvoltages which can be naturally obtained with electrodes of chemically-resistant materials (for instance carbon steel) free of catalytic activation were considered acceptable for a long time. The market nevertheless increasingly requires, for this specific technology, a caustic product of high concentration, making the use of carbon steel cathodes unviable due to corrosion problems. Moreover, the increase in the cost of energy has made the use of catalysts facilitating the cathodic evolution of hydrogen economically more convenient. One possible solution is the use of nickel substrates, chemically more resistant than carbon steel, coupled with platinum-based catalytic coatings. Cathodes of such kind are normally characterised by acceptably reduced cathode overvoltages, resulting rather expensive due to their content of platinum and to their limited operative lifetime, probably caused by the poor adhesion of the coating to the substrate. A partial improvement in the adhesion of catalytic coatings on nickel substrates can be obtained by adding cerium to the formulation of the catalytic layer, optionally as an external porous layer aimed at protecting the underlying platinum-based catalytic layer. However, this type of cathode is prone to suffer considerable damages following the occasional current reversals inevitably taking place in the case of malfunctioning of industrial plants.

A partial improvement in the current reversal tolerance is obtainable by activating the nickel cathodic substrate with a coating consisting of two distinct phases, a first phase containing the noble metal-based catalyst and a second phase comprising palladium, optionally in admixture with silver, having a protective function. This kind of electrode presents, however, a sufficient catalytic activity only when the noble metal phase contains high amounts of platinum, preferably with a significant addition of rhodium. Replacing platinum with cheaper ruthenium in the catalytic phase entails, for example, the onset of considerably higher cathodic overvoltages. Furthermore, the preparation of the coating consisting of two distinct phases requires an extremely delicate process control to achieve sufficiently reproducible results.

There is then a need for providing a new cathode composition for industrial electrolytic processes, in particular for electrolytic processes with cathodic evolution of hydrogen, characterised, with respect to prior art formulations, by an equivalent or higher catalytic activity, a lower overall cost in terms of raw materials, a higher reproducibility of preparation, and a lifetime and tolerance to accidental current reversal equivalent or higher in the usual operative conditions.

SUMMARY OF THE INVENTION

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter. As provided herein, the invention comprises, under one aspect a precursor suitable for the production of an electrode for gas evolution in electrolytic processes comprising a ruthenium nitrate dissolved in a chloride-free aqueous solution containing acetic acid at a concentration higher than 30% by weight.

In a further aspect, the invention comprises a method for the preparation of a precursor for the production of an electrode for gas evolution in electrolytic processes comprising preparing a ruthenium solution by dissolution of ruthenium nitrate in glacial acetic acid under stirring, with the optional addition of nitric acid and diluting the ruthenium solution with an aqueous solution of acetic acid at a concentration of 5 to 20% by weight.

In yet another aspect, the invention comprises a method for the preparation of a precursor, comprising the simultaneous or sequential steps of preparing a ruthenium solution by dissolution of ruthenium nitrate in glacial acetic acid under stirring, with optional addition of nitric acid, preparing a rare earth solution by dissolution of at least one nitrate of a rare earth in glacial acetic acid under stirring, with optional addition of nitric acid, mixing, under optional stirring, the ruthenium solution with the rare earth solution, and subsequently, optional dilution with an aqueous solution of acetic acid at a concentration of 5 to 20% by weight.

In a still further aspect, the invention comprises Method for manufacturing an electrode for gas evolution in electrolytic processes, comprising applying a precursor to a metal substrate in multiple coats, the precursor comprising a ruthenium nitrate dissolved in a chloride-free aqueous solution containing acetic acid at a concentration higher than 30% by weight, and performing a thermal decomposition at 400° C. to 600° C. for a time of no less than 2 minutes after each coat.

To the accomplishment of the foregoing and related ends, the following description sets forth certain illustrative aspects and implementations. These are indicative of but a few of the various ways in which one or more aspects may be employed. Other aspects, advantages, and novel features of the disclosure will become apparent from the following detailed description.

DESCRIPTION

Various aspects of the invention are set out in the accompanying claims.

In one embodiment, an electrode for electrolytic processes comprises a metal substrate, for instance made of nickel, copper or carbon steel, coated with a catalytic layer comprising from about 4 to about 40 (grams/square meter) g/m$^2$ of ruthenium, optionally in the form of an oxide, prepared by application and thermal decomposition in multiple coats of a precursor comprising a nitrate of ruthenium in acetic solution free of chlorides. In one embodiment, the catalytic later also contains from about 1 to about 10 g/m$^2$ of rare earths, for instance praseodymium, in the form of oxides, and optionally from about 0.4 to about 4 g/m$^2$ of palladium.

Under another aspect, a precursor suitable for the manufacturing of an electrode for gas evolution in electrolytic processes, for instance cathodic evolution of hydrogen, comprises a nitrate of ruthenium dissolved in a chloride-free solution containing, in one embodiment, more than 30%, and in another embodiment from about 35 to about 50% by weight, of acetic acid. The inventors surprisingly observed that the activity, the duration and the tolerance to reversals of electrodes used as cathodes for hydrogen evolution catalysed with ruthenium are superior provided nitrate-based precursors in a substantially chloride-free acetic solution are used in the manufacturing thereof, instead of the common precursor of the prior art consisting of $RuCl_3$ in hydrochloric solution. Without wishing to limit the invention to any particular theory, this may be due to the formation of a complex species wherein a ruthenium atom is coordinated with acetic or carbonyl groups, in the absence of coordination bonds with chloride. This complex species imparts morphological, structural or compositional effects reflected in improved performances of the electrode obtained by means of their decomposition, especially in terms of duration and current reversal tolerance. In one embodiment, the nitrate of ruthenium employed is Ru (III) nitrosyl nitrate, a commercially available compound expressed by the formula $Ru(NO)(NO_3)_3$ or sometimes written as $Ru(NO)(NO_3)_x$ to indicate that the average oxidation state of ruthenium may be slightly different than 3. This species, that in one embodiment is present in the precursor at a concentration of from about 60 (grams/liter) g/l to about 200 g/l, has the advantage of being easily available in amounts sufficient to an industrial production of electrodes. In one embodiment, the precursor solution also comprises rare earth nitrates, which have the advantage of providing further stability to the electrode coating obtainable by thermal decomposition of the same precursor. The inventors have found that the addition of $Pr(NO_3)_2$ at a concentration of about 15 to about 50 g/l imparts desirable features of functioning stability and tolerance to current reversals to the coating obtained by decomposition of the precursor. In one embodiment, the precursor solution also comprises from about 5 to about 30 g/l of palladium nitrate. The presence of palladium in the coating obtainable by thermal decomposition of the precursor can have the advantage of imparting an enhanced tolerance to current reversals, especially in the long term.

Under another aspect, a method for producing a ruthenium-based precursor suitable for manufacturing an electrode for gas evolution in electrolytic processes comprises the preparation of a ruthenium solution by dissolution of ruthenium nitrate in glacial acetic acid under stirring, optionally adding a few droplets of nitric acid to facilitate its dissolution, followed by a dilution with 5-20% by weight acetic acid until obtaining the required concentration of ruthenium. In one embodiment, a method for manufacturing a ruthenium and rare earth-based precursor comprises the preparation of a ruthenium solution by dissolution of a ruthenium nitrate in glacial acetic acid under stirring, optionally adding a few droplets of nitric acid; the preparation of a rare earth solution by dissolution of a rare earth nitrate, for instance $Pr(NO_3)_2$, in glacial acetic acid under stirring, optionally adding a few droplets of nitric acid; the mixing, optionally under stirring, of the ruthenium solution with the rare earth solution; the dilution with 5-20% by weight acetic acid until obtaining the required concentration of ruthenium and of rare earth. In one embodiment, the dilution with 5-20% acetic acid may also be effected on the ruthenium solution and/or on the rare earth solution before mixing.

Under another aspect, a method for manufacturing an electrode for gas evolution in electrolytic processes, for instance for cathodic evolution of hydrogen, comprises the application in multiple coats on a metal substrate and the subsequent thermal decomposition at 400° C. to 600° C. of a ruthenium nitrate-based precursor with the optional addition of nitrates of rare earths or palladium in acetic solution as previously described. The precursor may be applied to a mesh or to an expanded or punched mesh of nickel, for instance by means of electrostatic spray techniques, brushing, dipping or other known techniques. After the deposition of each coat of precursor, the substrate may be subjected to a drying step, for instance of 5-15 minutes at 80° C. to 100° C., followed by thermal decomposition at 400° C. to 600° C. for a time not lower than two minutes and usually comprised between 5 and 20 minutes. The above-indicated concentrations indicatively allow the deposition of 10-15 g/m$^2$ of ruthenium in 4-10 coats.

Some of the most significant results obtained by the inventors are described in the following examples which are not intended to limit the extent of the invention.

Example 1

An amount of $Ru(NO)(NO_3)_3$ corresponding to 100 g of Ru was dissolved in 300 ml of glacial acetic acid with the addition of a few milliliters (ml) of concentrated nitric acid. The solution was stirred for three hours keeping the temperature at 50° C. The solution was then brought to a volume of 500 ml with 10% by weight acetic acid (ruthenium solution).

Separately, an amount of $Pr(NO_3)_2$ corresponding to 100 g of Pr was dissolved in 300 ml of glacial acetic acid with the addition of a few ml of concentrated nitric acid. The solution was stirred for three hours keeping the temperature at 50° C. The solution was then brought to a volume of 500 ml with 10% by weight acetic acid (rare earth solution).

480 ml of the ruthenium solution was mixed with 120 ml of the rare earth solution and left under stirring for five minutes. The thus obtained solution was brought to 1 liter with 10% by weight acetic acid (precursor).

A mesh of nickel 200 of 100 mm×100 mm×0.89 mm size was subjected to a process of blasting with corundum, etching in 20% HCl at 85° C. for 2 minutes and thermal annealing at 500° C. for 1 hour. The precursor was then applied by brushing in 6 subsequent coats, carrying out a drying treatment for 10 minutes at 80° C. to 90° C. and a thermal decomposition for 10 minutes at 500° C. after each coat until obtaining a deposition of 11.8 g/m$^2$ of Ru and 2.95 g/m$^2$ of Pr.

The sample was subjected to a performance test, showing an ohmic drop-corrected initial cathodic potential of −924 mV/NHE at 3 kA/m$^2$ under hydrogen evolution in 33% NaOH, at a temperature of 90° C., which indicates an excellent catalytic activity.

The same sample was subsequently subjected to cyclic voltammetry in a range of −1 to +0.5 V/NHE at a 10 mV/s scan rate; after 25 cycles, the cathodic potential was −961 mV/NHE, which indicates an excellent current reversal tolerance.

Example 2

An amount of $Ru(NO)(NO_3)_3$ corresponding to 100 g of Ru was dissolved in 300 ml of glacial acetic acid with the addition of few ml of concentrated nitric acid. The solution was stirred for three hours keeping the temperature at 50° C. The solution was then brought to a volume of 1 liter with 10% by weight acetic acid (precursor).

A mesh of nickel 200 of 100 mm×100 mm×0.89 mm size was subjected to a process of blasting with corundum, etching in 20% HCl at 85° C. for 2 minutes and thermal annealing at 500° C. for 1 hour. The previously obtained precursor was then applied by brushing in 7 subsequent coats, carrying out a drying treatment for 10 minutes at 80-90° C. and a thermal decomposition for 10 minutes at 500° C. after each coat until obtaining a deposition of 12 g/m$^2$ of Ru.

The sample was subjected to a performance test, showing an ohmic drop-corrected initial cathodic potential of −925 mV/NHE at 3 kA/m$^2$ under hydrogen evolution in 33% NaOH, at a temperature of 90° C., which indicates an excellent catalytic activity.

The same sample was subsequently subjected to cyclic voltammetry in a range of −1 to +0.5 V/NHE at a 10 mV/s scan rate. After 25 cycles, the cathodic potential was −979 mV/NHE, which indicates an excellent current reversal tolerance.

Counterexample 1

A mesh of nickel 200 of 100 mm×100 mm×0.89 mm size was subjected to a process of blasting with corundum, etching in 20% HCl at 85° C. for 2 minutes and thermal annealing at 500° C. for 1 hour. The mesh was then activated by applying $RuCl_3$ in nitric solution by brushing at a concentration of 96 g/l, carrying out a drying treatment for 10 minutes at 80° C. to 90° C. and a thermal decomposition for 10 minutes at 500° C. after each coat until obtaining a deposition of 12.2 g/m$^2$ of Ru.

The sample was subjected to a performance test, showing an ohmic drop-corrected initial cathodic potential of −942 mV/NHE at 3 kA/m$^2$ under hydrogen evolution in 33% NaOH, at a temperature of 90° C., which indicates a fair catalytic activity.

The same sample was subsequently subjected to cyclic voltammetry in a range of −1 to +0.5 V/NHE at a 10 mV/s scan rate. After 25 cycles, the cathodic potential was −1100 mV/NHE, which indicates a modest current reversal tolerance.

Counterexample 2

An amount of $RuCl_3$ corresponding to 100 g of Ru was dissolved in 300 ml of glacial acetic acid with the addition of a few ml of concentrated nitric acid. The solution was stirred for three hours keeping the temperature at 50° C. The solution was then brought to a volume of 500 ml with 10% by weight acetic acid (ruthenium solution).

Separately, an amount of $Pr(NO_3)_2$ corresponding to 100 g of Pr was dissolved in 300 ml of glacial acetic acid with addition of few ml of concentrated nitric acid. The solution was stirred for three hours keeping the temperature at 50° C. The solution was then brought to a volume of 500 ml with 10% by weight acetic acid (rare earth solution).

480 ml of the ruthenium solution was mixed with 120 ml of the rare earth solution and left under stirring for five minutes. The thus obtained solution was brought to 1 liter with 10% by weight acetic acid (precursor).

A mesh of nickel 200 of 100 mm×100 mm×0.89 mm size was subjected to a process of blasting with corundum, etching in 20% HCl at 85° C. for 2 minutes and thermal annealing at 500° C. for 1 hour. The precursor was then applied by brushing in 7 subsequent coats, carrying out a drying treatment for 10 minutes at 80° C. to 90° C. and a thermal decomposition for 10 minutes at 500° C. after each coat until obtaining a deposition of 12.6 g/m$^2$ of Ru and 1.49 g/m$^2$ of Pr.

The sample was subjected to a performance test, showing an ohmic drop-corrected initial cathodic potential of −932 mV/NHE at 3 kA/m$^2$ under hydrogen evolution in 33% NaOH, at a temperature of 90° C., which indicates a good catalytic activity.

The same sample was subsequently subjected to cyclic voltammetry in a range of −1 to +0.5 V/NHE at a 10 mV/s scan rate. After 25 cycles, the cathodic potential was −1080 mV/NHE, which indicates a modest current reversal tolerance.

Counterexample 3

An amount of $Ru(NO)(NO_3)_3$ corresponding to 100 g of Ru was dissolved in 500 ml of 37% by volume hydrochloric acid with the addition of a few ml of concentrated nitric acid. The solution was stirred for three hours keeping the temperature at 50° C. The solution was then brought to a volume of 500 ml with 10% by weight acetic acid (ruthenium solution).

Separately, an amount of $Pr(NO_3)_2$ corresponding to 100 g of Pr was dissolved in 500 ml of 37% by volume hydrochloric acid with the addition of a few ml of concentrated nitric acid. The solution was stirred for three hours keeping the temperature at 50° C. (rare earth solution).

480 ml of the ruthenium solution was mixed with 120 ml of the rare earth solution and left under stirring for five minutes. The thus obtained solution was brought to 1 liter with 1 N hydrochloric acid (precursor).

A mesh of nickel 200 of 100 mm×100 mm×0.89 mm size was subjected to a process of blasting with corundum, etching in 20% HCl at 85° C. for 2 minutes and thermal annealing at 500° C. for 1 hour. The precursor was then applied by brushing in 7 subsequent coats, carrying out a drying treatment for 10 minutes at 80° C. to 90° C. and a thermal decomposition for 10 minutes at 500° C. after each coat until obtaining a deposition of 13.5 g/m$^2$ of Ru and 1.60 g/m$^2$ of Pr.

The sample was subjected to a performance test, showing an ohmic drop-corrected initial cathodic potential of −930 mV/NHE at 3 kA/m$^2$ under hydrogen evolution in 33% NaOH, at a temperature of 90° C., which indicates a good catalytic activity.

The same sample was subsequently subjected to cyclic voltammetry in a range of −1 to +0.5 V/NHE at a 10 mV/s scan rate. After 25 cycles, the cathodic potential was −1090 mV/NHE, which indicates a modest current reversal tolerance.

The previous description shall not be intended as limiting the invention, which may be used according to different embodiments without departing from the scopes thereof, and whose extent is solely defined by the appended claims.

Throughout the description and claims of the present application, the term "comprise" and variations thereof such as "comprising" and "comprises" are not intended to exclude the presence of other elements, components or additional process steps.

What we claim is:

1. Precursor suitable for the production of an electrode for gas evolution in electrolytic processes, comprising a ruthenium nitrate dissolved in a chloride-free aqueous solution containing acetic acid at a concentration higher than 30% by weight.

2. The precursor according to claim 1, wherein the concentration of the acetic acid is 35 to 50% by weight.

3. The precursor according to claim 1, wherein the ruthenium nitrate is ruthenium nitrosyl nitrate at a concentration of 60 to 200 g/l.

4. A precursor suitable for the production of an electrode for gas evolution in electrolytic processes, comprising a ruthenium nitrate dissolved in a chloride-free aqueous solution containing acetic acid at a concentration higher than 30% by weight, wherein the aqueous solution comprises at least one nitrate of a rare earth.

5. The precursor according to claim 4, wherein the at least one nitrate of a rare earth is $Pr(NO_3)_2$ at a concentration of 15 to 50 g/l.

6. The precursor according to claim 4, wherein the aqueous solution comprises palladium nitrate at a concentration of 5 to 30 g/l.

7. A method for the preparation of a precursor for the production of an electrode for gas evolution in electrolytic processes comprising:

preparing a ruthenium solution by dissolution of ruthenium nitrate in glacial acetic acid under stifling, with the optional addition of nitric acid; and diluting the ruthenium solution with an aqueous solution of acetic acid at a concentration of 5 to 20% by weight.

8. A method for the preparation of a precursor, comprising the following simultaneous or sequential steps:

preparing a ruthenium solution by dissolution of ruthenium nitrate in glacial acetic acid under stifling, with optional addition of nitric acid;

preparing a rare earth solution by dissolution of at least one nitrate of a rare earth in glacial acetic acid under stifling, with optional addition of nitric acid;

mixing, under optional stifling, the ruthenium solution with the rare earth solution; and subsequently, optional dilution with an aqueous solution of acetic acid at a concentration of 5 to 20% by weight.

9. The method according to claim 8, further comprising diluting the ruthenium solution and/or the rare earth solution with an aqueous solution of acetic acid at a concentration of 5 to 20% by weight before the mixing step.

10. Electrode for cathodic hydrogen evolution in electrolytic processes comprising a metal substrate coated with a catalytic layer containing 4 to 40 g/m2 of ruthenium in form of metal or oxide obtained by the method according claim 9.

11. The electrode according to claim 10, wherein the catalytic layer further contains 1 to 10 g/m2 of rare earths in the form of oxides, and optionally 0.4 to 4 g/m2 of palladium in the form of an oxide or a metal.

12. The electrode according to claim 11, wherein the rare earths comprise praseodymium oxide.

13. The electrode according to claim 10, wherein the metal substrate comprises nickel or nickel alloy.

14. Method for manufacturing an electrode for gas evolution in electrolytic processes, comprising:

applying a precursor to a metal substrate in multiple coats, the precursor comprising a ruthenium nitrate dissolved in a chloride-free aqueous solution containing acetic acid at a concentration higher than 30% by weight; and performing a thermal decomposition at 400° C. to 600° C. for a time of no less than 2 minutes after each coat.

15. The method according to claim 14, wherein the metal substrate comprises a mesh or a punched or expanded sheet made of nickel.

* * * * *